US010492581B2

(12) United States Patent
Lv

(10) Patent No.: US 10,492,581 B2
(45) Date of Patent: Dec. 3, 2019

(54) ELECTRICALLY FOLDING AND UNFOLDING MULTI-FOLD UMBRELLA

(71) Applicants: SHENZHEN YUANFA UMBRELLA CO., LTD., Shenzhen, Guangdong (CN); Sunbao Lv, Nanan, Fujian (CN)

(72) Inventor: Sunbao Lv, Nanan (CN)

(73) Assignees: SHENZHEN YUANFA UMBRELLA CO., LTD., Shenzhen (CN); Sunbao Lv, Nanan (CN)

( * ) Notice: Subject to any disclaimer, the term of this patent is extended or adjusted under 35 U.S.C. 154(b) by 0 days.

(21) Appl. No.: 16/087,414

(22) PCT Filed: Mar. 2, 2017

(86) PCT No.: PCT/CN2017/075490
§ 371 (c)(1),
(2) Date: Sep. 21, 2018

(87) PCT Pub. No.: WO2017/162014
PCT Pub. Date: Sep. 28, 2017

(65) Prior Publication Data

US 2019/0059534 A1 Feb. 28, 2019

(30) Foreign Application Priority Data

Mar. 22, 2016 (CN) ..... 2016 1 0167706

(51) Int. Cl.
*A45B 25/14* (2006.01)
*A45B 19/10* (2006.01)
*A45B 25/16* (2006.01)

(52) U.S. Cl.
CPC ..... *A45B 25/14* (2013.01); *A45B 19/10* (2013.01); *A45B 25/165* (2013.01)

(58) Field of Classification Search
CPC ..... A45B 25/143; A45B 25/165; A45B 25/14; A45B 2019/023
See application file for complete search history.

(56) References Cited

U.S. PATENT DOCUMENTS 7,735,498 B2 * 6/2010 You ..... A45B 25/143 135/24
7,997,290 B2 * 8/2011 Stoelinga ..... A45B 25/14 135/20.3

(Continued)

FOREIGN PATENT DOCUMENTS

CN 2822302 10/2006
CN 201370194 12/2009

(Continued)

OTHER PUBLICATIONS

International search report dated May 19, 2017 from corresponding application No. PCT/CN2017/075490.

(Continued)

*Primary Examiner* — Noah Chandler Hawk
(74) *Attorney, Agent, or Firm* — Hauptman Ham, LLP

(57) ABSTRACT

Disclosed is an electrically folding and unfolding multi-fold umbrella, which includes a handle, a pull cord, and an intermediate shaft, the handle is defined at one end of the intermediate shaft, an upper nest and a lower nest are defined at two sides of the intermediate shaft respectively, and the lower nest is adjacent to the handle, a motor, a first gear, and at least one pulley are all located in the upper nest, the first gear is coaxial with one pulley, a side of the motor defines a lead screw, an axis of the pulley is connected to an inner surface of the upper nest, a fixed pulley is defined at a side of an inner surface of the lower nest, one end of the pull cord is fixed in the end of the intermediate shaft, the other end of the pull cord is fixed on the upper nest.

11 Claims, 6 Drawing Sheets

(56) References Cited

U.S. PATENT DOCUMENTS

| | | | | |
|---|---|---|---|---|
| 8,757,183 | B2 * | 6/2014 | Volin | A45B 25/143 135/20.3 |
| 8,857,453 | B2 * | 10/2014 | Souma | A45B 25/143 135/20.3 |
| 2005/0166950 | A1 * | 8/2005 | Grady, II | A45B 25/143 135/75 |
| 2009/0145469 | A1 * | 6/2009 | Pirlo | A45B 25/143 135/16 |
| 2009/0293925 | A1 | 12/2009 | You | |

FOREIGN PATENT DOCUMENTS

| | | |
|---|---|---|
| CN | 101836786 | 9/2010 |
| CN | 202496557 | 10/2012 |
| CN | 202603859 | 12/2012 |
| CN | 202664509 | 1/2013 |
| CN | 105029854 | 11/2015 |
| CN | 105639914 | 6/2016 |
| CN | 205492856 | 8/2016 |
| GB | 2250191 | 6/1992 |

OTHER PUBLICATIONS

Office Action dated Feb. 4, 2017 from corresponding application No. CN 201610167706.6.

* cited by examiner

ELECTRICALLY FOLDING AND UNFOLDING MULTI-FOLD UMBRELLA

RELATED APPLICATIONS

The present application is a National Phase of International Application Number PCT/CN2017/075490, filed Mar. 2, 2017, and claims the priority of China Application No. 201610167706.6, filed Mar. 22, 2016.

FIELD

The disclosure generally relates to the technical field of umbrella, and more particularly relates to an electrically folding and unfolding multi-fold umbrella.

BACKGROUND

Umbrellas are necessary in peoples' daily lives. People has put a lot of effort on the researching of umbrellas, and has developed manual umbrellas, automatic umbrellas, and electrically folding and unfolding multi-fold umbrellas. Currently, for the electrically folding and unfolding umbrella in the market, the motor of the umbrella is normally defined in the umbrella's handle, resulting in that the umbrella is overlong, which is inconvenient for people to use and carry.

SUMMARY

It is therefore one main object of this disclosure to provide an electrically folding and unfolding multi-fold umbrella, aiming to reduce the length of the electrically folding and unfolding multi-fold umbrella in a folding state, as such the electrically folding and unfolding multi-fold umbrella is convenient to use and carry.

In order to achieve the above object, the electrically folding and unfolding multi-fold umbrella provided by the present disclosure includes a handle, a pull cord, and an intermediate shaft fixedly connected with the handle, the handle is defined at one end of the intermediate shaft, an upper nest and a lower nest are defined at two sides of the intermediate shaft respectively, and the lower nest is adjacent to the handle, a motor, a first gear, and at least one pulley are all located in the upper nest, the first gear is coaxial with one pulley, a side of the motor adjacent to the handle defines a lead screw which is engaged with the first gear, an axis of the pulley is connected to an inner surface of the upper nest, a fixed pulley is defined at a side of an inner surface of the lower nest, one end of the pull cord is fixed in the end of the intermediate shaft adjacent to the handle, the other end of the pull cord is fixed on the upper nest after steering by the pulley in the upper nest and the fixed pulley in the lower nest in sequence.

Preferably, there are three pulleys, axes of the three pulleys are all connected to the inner surface of the upper nest, the pull cord steers by the three pulleys in sequence.

Preferably, there are three pulleys, axes of the three pulleys are all connected to the inner surface of the upper nest, a side of each of the pulleys back to the lead screw defines a second gear, and each two adjacent second gears are engaged with each other, each of the second gears is coaxial with one corresponding pulley, the pull cord steers by the pulleys in sequence.

Preferably, a battery, an electric wire, and a switch component are located in the handle, the switch component is connected with the battery through the electric wire, a spring and a spring type wire are defined in the intermediate shaft, the switch component is connected with the motor through the spring and the spring type wire, an outer surface of the handle defines a control button which is capable to contact with the switch component.

Preferably, the control button includes an unfolding button and a folding button, orientations of the unfolding button and the folding button on the outer surface of the handle are consistent with an extending direction of the intermediate shaft.

Preferably, the battery is a rechargeable battery.

Preferably, the switch component includes a switch button, a double-pole double-throw switch, a bottom clamping portion, a button clamping portion, and a button spring, the switch button and the button clamping portion are respectively defined at two opposite sides of a top end of the handle, two ends of the button spring respectively resist on the button clamping portion and an inner surface of the handle, the button clamping portion is defined at the end of the intermediate shaft adjacent to the handle, and the bottom clamping portion resists on the button clamping portion, the electric wire is respectively connected with the battery, the double-pole double-throw switch, the switch button, the spring, and the spring type wire.

Preferably, the intermediate shaft includes an outer tube, at least one intermediate tube, and an inner tube, the inner tube, the at least one intermediate tube and the outer tube are sequentially sleeved one over the other from inside to outside, the intermediate tube is capable to slide relative to the inner tube, and the outer tube is capable to slide relative to the intermediate tube.

Preferably, the handle is fixed at one end of the inner tube, the lower nest is movably sleeved around an outer surface of the outer tube, the upper nest is fixed at one end of the outer tube back to the handle.

Preferably, the electrically folding and unfolding multi-fold umbrella includes a first rib, a second rib, and a tension spring, one end of the first rib is connected with the upper nest, two ends of the second rib are respectively connected with a side of the lower nest and a side of the first rib adjacent to the upper nest, two ends of the tension spring are respectively connected with the first rib and the second rib.

Preferably, the first rib is a multi-fold first rib.

In the technical proposal of the present disclosure, the motor having the lead screw is located in the upper nest of the electrically folding and unfolding multi-fold umbrella, the motor can rotate in a forward direction, or in a backward direction, to bring the lead screw to rotate in the forward direction, or in the backward direction, as such the first gear engaged with the lead screw can also rotate in different directions, to bring the pulley coaxially defined with the first gear to rotate in different directions, the pulley rotates to bring the pull cord to move, for folding or unfolding the electrically folding and unfolding multi-fold umbrella. Compared with the electrically folding and unfolding multi-fold umbrella in the existing technology with a motor in a handle, the length of the electrically folding and unfolding multi-fold umbrella of the present disclosure can be effectively reduced, which is convenient to use and carry; and the structure is much more simpler, the rotation of the pulley is much more fast, as such it is more convenient to fold and unfold the electrically folding and unfolding multi-fold umbrella.

BRIEF DESCRIPTION OF THE DRAWINGS

To better illustrate the technical solutions that are reflected in various embodiments according to this disclosure or that are found in the prior art, the accompanying drawings intended for the description of the embodiments herein or for the prior art will now be briefly described, it is evident that the accompanying drawings listed in the following description show merely some embodiments according to this disclosure, and that those having ordinary skill in the art will be able to obtain other drawings based on the arrangements shown in these drawings without making inventive efforts, where in these drawings.

Labels illustration for drawings.

TABLE 1

Figure 1:
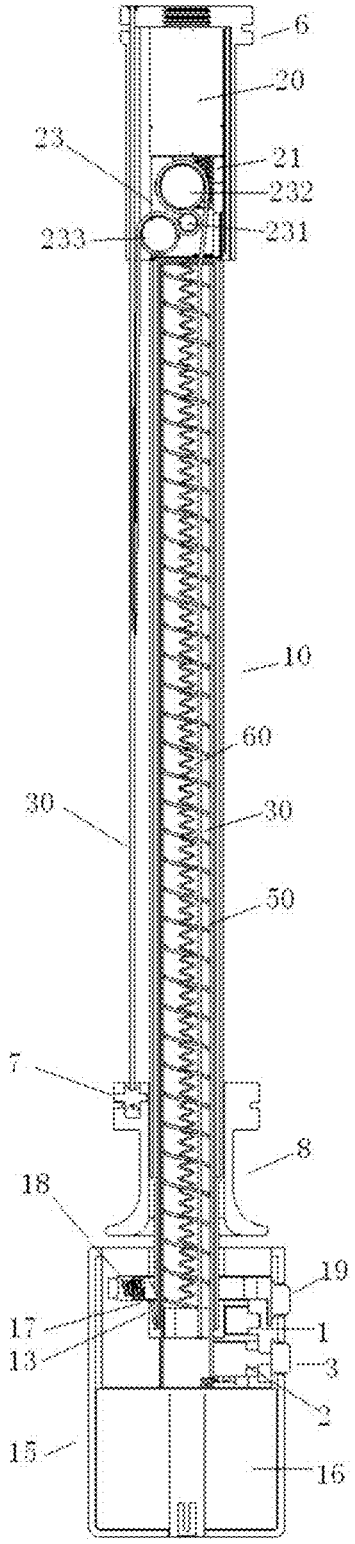
FIG. 1 is a structure diagram of the electrically folding and unfolding multi-fold umbrella without rib in the folding state according to a first exemplary embodiment of the present disclosure.

| Label | Name | Label | Name |
|---|---|---|---|
| 1 | control button | 2 | double-pole double-throw switch |
| 3 | folding button | 4 | electric wire |
| 5 | switch component | 6、6A | upper nest |
| 7 | fixed pulley | 8 | lower nest |
| 9 | outer tube | 10 | intermediate shaft |
| 11 | intermediate tube | 12 | inner tube |
| 13 | bottom clamping portion | 15 | handle |
| 16 | battery | 17 | button clamping portion |
| 18 | button spring | 19 | unfolding button |
| 20、20A | motor | 21 | first gear |
| 22、22A | lead screw | 23、23A | pulley |
| 24A | second gear | 231、231A | small pulley |
| 232、232A | large pulley | 233、233A | medium size pulley |
| 30、30A | pull cord | 50 | spring |
| 60 | spring type wire | 70 | first rib |
| 71 | second rib | 80 | tension spring |

The realization of the aim, functional characteristics, advantages of the present disclosure are further described specifically with reference to the accompanying drawings and embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all the directional instructions of in the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggestting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

In the present disclosure, unless specified or limited otherwise, the terms "connected", "fixed" and the like are used broadly, and for example, "fixed" can be fixed connections, detachable connections, or integral connections; may also be mechanical or electrical connections; may also be direct connections or indirect connections via intervening structures, may also be inner connecting of two elements, or interaction relationship between two elements, unless specifically limited otherwise. which can be understood by those skilled in the art according to specific situations, which can be understood by those skilled in the art according to the detail embodiment of the present disclosure.

In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides an electrically folding and unfolding multi-fold umbrella.

Embodiment One

Figure 2:
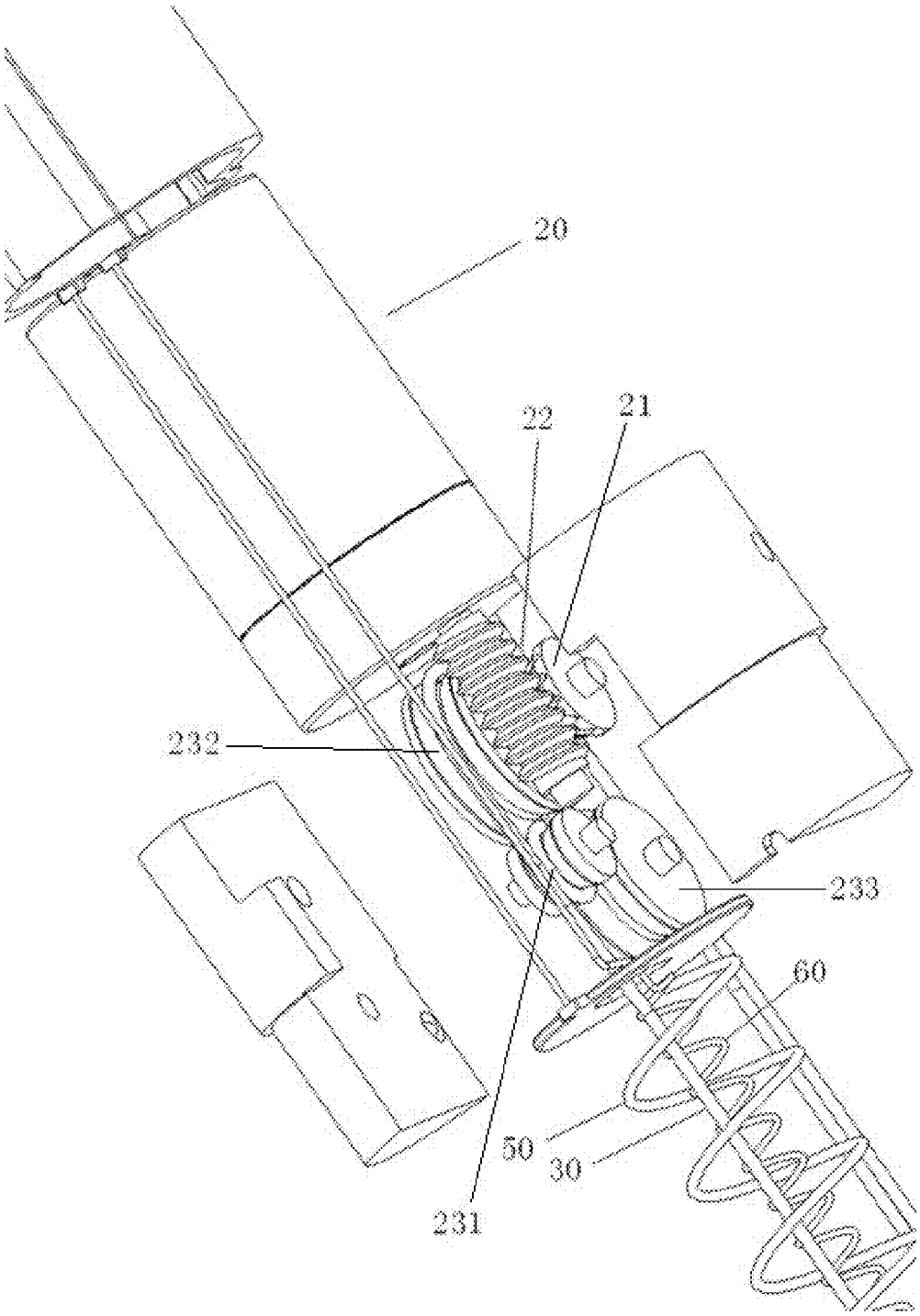
FIG. 2 is a structure diagram of the motor and the pulley of the electrically folding and unfolding multi-fold umbrella shown in FIG. 1.
Figure 3:
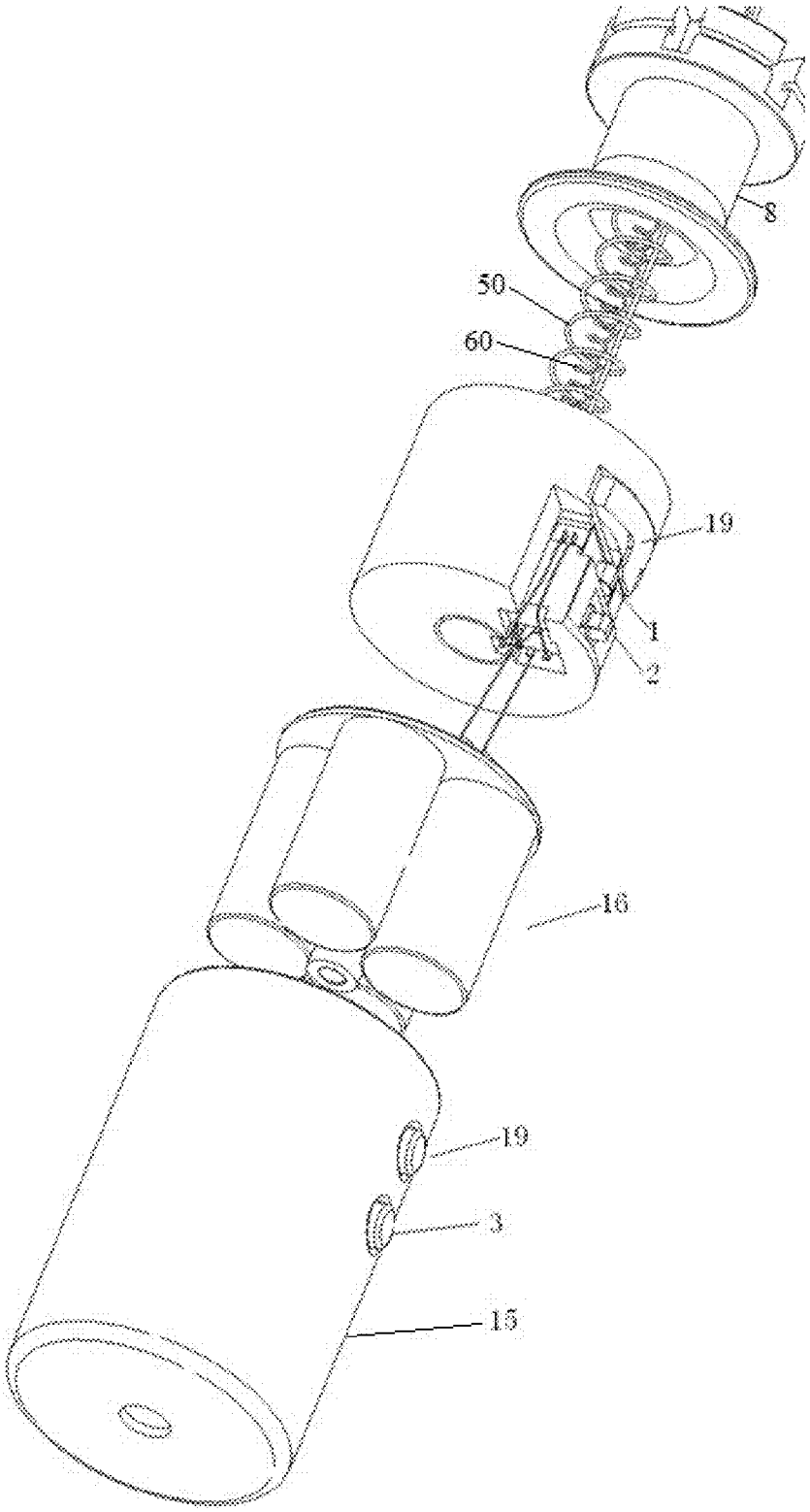
FIG. 3 is a structure diagram of the handle and the lower nest of the electrically folding and unfolding multi-fold umbrella shown in FIG. 1.
Figure 4:
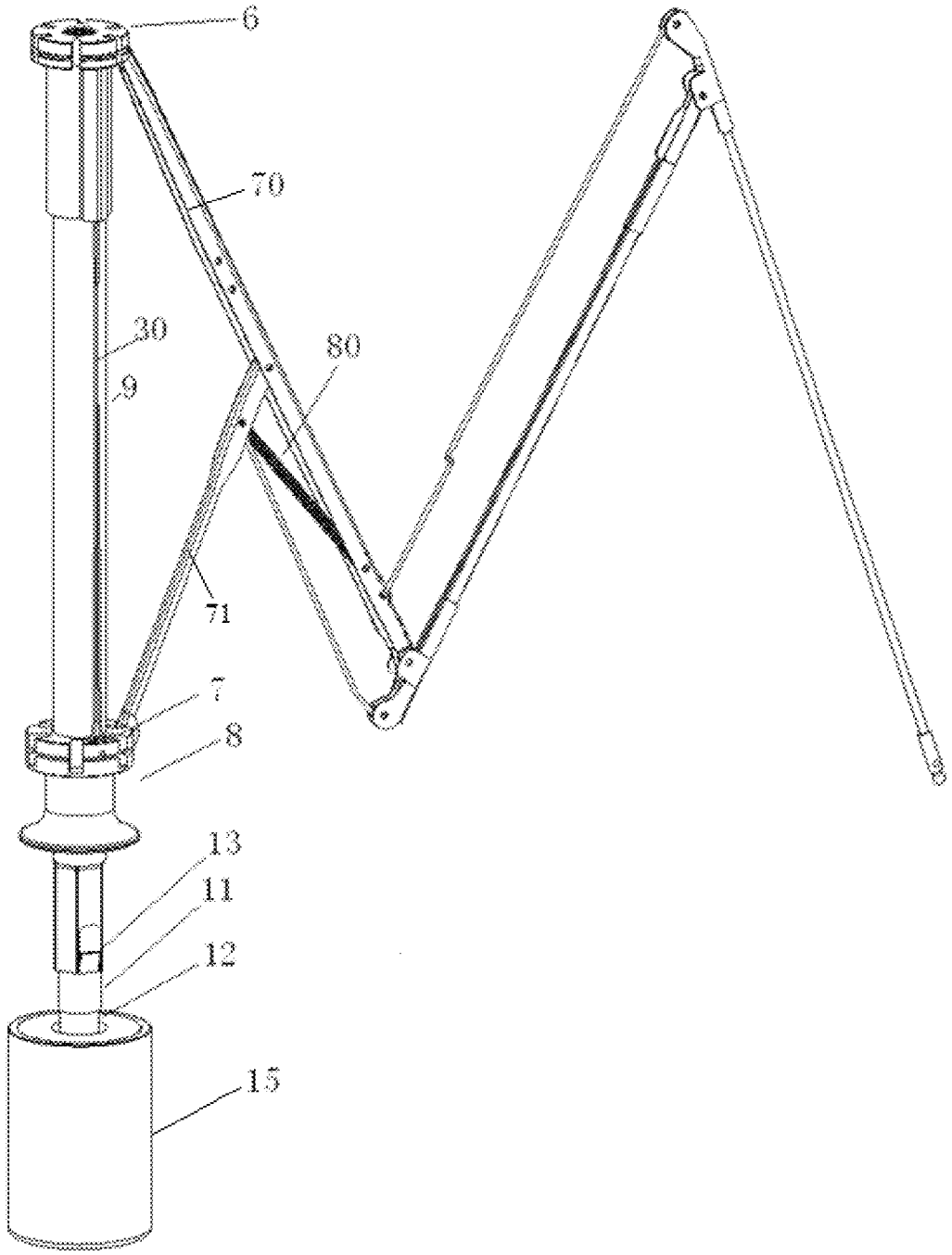
FIG. 4 is a structure diagram of the electrically folding and unfolding multi-fold umbrella shown in FIG. 1.
Figure 5:
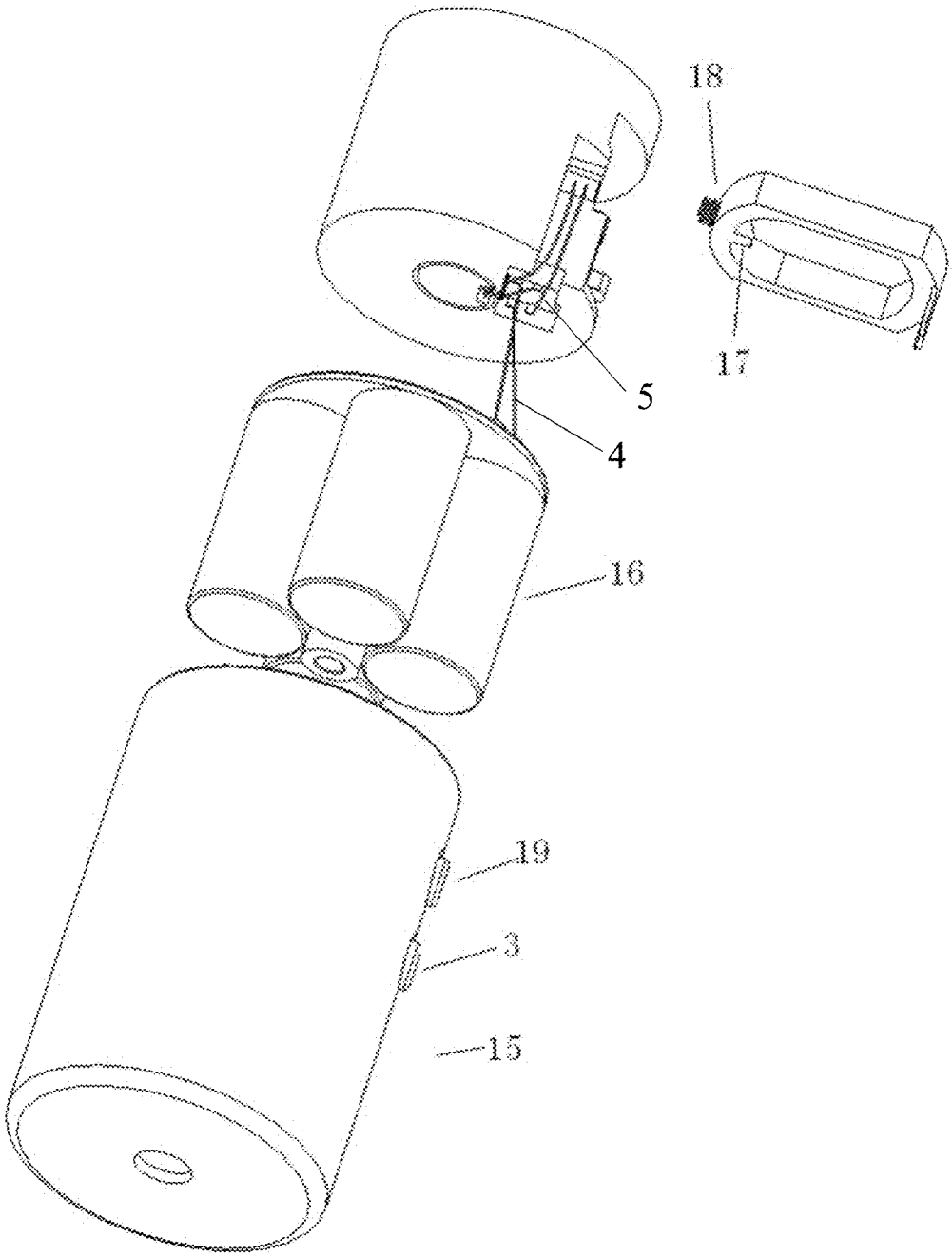
FIG. 5 is an exploded diagram of the handle of the electrically folding and unfolding multi-fold umbrella shown in FIG. 1.

FIG. 1 is a structure diagram of the electrically folding and unfolding multi-fold umbrella without rib in the folding state according to a first exemplary embodiment of the present disclosure; FIG. 2 is a partial enlarged diagram of the motor and the pulley of the electrically folding and unfolding multi-fold umbrella shown in FIG. 1; FIG. 3 is an exploded diagram of the handle and the intermediate shaft connected with the handle of the electrically folding and unfolding multi-fold umbrella shown in FIG. 1; FIG. 4 is a structure diagram of the electrically folding and unfolding multi-fold umbrella shown in FIG. 1; FIG. 5 is an exploded diagram of the handle of the electrically folding and unfolding multi-fold umbrella shown in FIG. 1.

Referring to FIGS. 1-2, in an exemplary embodiment, the electrically folding and unfolding multi-fold umbrella includes a handle 15, a pull cord 30, and an intermediate shaft 10 fixedly connected with the handle 15, the handle 15 is defined at one end of the intermediate shaft 10, an upper nest 6 and a lower nest 8 are defined at two sides of the intermediate shaft 10 respectively, and the lower nest 6 is adjacent to the handle 15, a motor 20, a first gear 21, and at least one pulley 23 are all located in the upper nest 6, the first gear 21 is coaxial with one pulley 23, a side of the motor 20 adjacent to the handle 15 defines a lead screw 22 which is engaged with the gear 21, an axis of the pulley 23 is connected to an inner surface of the upper nest 6, a fixed pulley 8 is defined at a side of an inner surface of the lower nest 8, one end of the pull cord 30 is fixed in the end of the intermediate shaft 10, the other end of the pull cord 30 is fixed on the upper nest 6 after steering by the pulley 23 in the upper nest 6 and the fixed pulley 7 in the lower nest 8 in sequence.

When the motor 20 rotates in a forward direction, the lead screw 22 defined at the side of the motor 20 can bring the first gear 21 to rotate, and further bring one pulley 23 coaxially defined with the first gear 21 to rotate in one direction, as such the pull cord 30 coiled around the pulley 23 can move along one direction, the pull cord 30 brings the lower nest 8 to move toward the upper nest 6 through the fixed pulley 8 located in the lower nest 8, as such the umbrella is unfolded; similarly, when the motor 20 rotates in a backward direction, the motor 20 brings the pulley 23 and the pull cord 30 to move in sequence through the gear 21 engaged with the lead screw 22, as such the umbrella is folded. The pulley 23 can further bring the pull cord 30 to move to fold or unfold the umbrella through the cooperation between the first gear 21 and the lead screw 22. Compared with the existing technology, the electrically folding and unfolding multi-fold umbrella can be fast folded and unfolded, as such the using of the electrically folding and unfolding multi-fold umbrella is much more easier and faster.

Furthermore, there are three pulleys 23, axes of the three pulleys 23 are all connected to the inner surface of the upper nest 6, the pull cord 30 steers by the three pulleys 23 in sequence, to bring the pulleys 23 to rotate. In detail, the pulleys 23 includes a small pulley 231, a large pulley 232, and a medium size pulley 233, the large pulley 232 and the medium size pulley 233 are respectively defined at two sides of the small pulley 231, after one end of the pull cord 30 is fixed in the intermediate shaft 10, the other end of the pull cord 30 can steer by the large pulley 232, the small pulley 231, and the medium size pulley 233 in sequence, and then steer by the fixed pulley 7, finally can be fixed in the top end of the upper nest 6, one side of the large pulley 232 defines a first gear 21 which can be engaged with the the lead screw 22, the lead screw 22 can rotate to bring the large pulley 232 to rotate, the large pulley 232 can bring the small pulley 231 and the medium size pulley 233 to rotate in sequence through the pull cord 30, the pull cord 30 moves to fold or unfold the electrically folding and unfolding multi-fold umbrella. The setting of the multiple pulleys 23 can improve the frictional force between the pull cord 30 and the pulleys 23, to avoid the pull cord 30 from slipping on the pulleys 23, resulting in a strong cooperation between the pulleys 23 and the pull cord 30.

Referring to FIGS. 1, 3, and 5, a battery 16, an electric wire 4, and a switch component 5 are all located in the handle 15, the switch component 5 is connected with the battery 16 through the electric wire 4, a spring 50 and a spring type wire 60 are both located in the intermediate shaft 10, the switch component 5 is connected with the motor 20 through the spring 50 and the spring type wire 60, an outer surface of the handle 15 defines a control button (not shown) which is capable to contact with the switch component 5. In detail, the switch component 5 includes a switch button 1, a double-pole double-throw switch 2, a bottom clamping portion 13, a button clamping portion 17, and a button spring 18, the switch button 1 and the button clamping portion 17 are respectively defined at two opposite sides of a top end of the handle 15, two ends of the button spring 18 respectively resist on the button clamping portion 17 and an inner surface of the handle 15, the button clamping portion 13 is defined at one end of the intermediate shaft 10 adjacent to the handle 15, and the bottom clamping portion 13 resists on the button clamping portion 17, the electric wire 4 is respectively connected with the battery 16, the double-pole double-throw switch 2, the switch button 1, the spring 50, and the spring type wire 60, to form a complete circuit, the motor 20 can rotate in the forward direction or the back ward direction through connecting the switch button 1 and the double-pole double-throw switch 2 with the anode or cathode of the battery 16, and the electrical conductivities of the spring 50 and the spring type wire 60; in addition, the button clamping portion 17 can move towards the inner surface of the handle 15 through the retractable button spring 18 by pressing the control button (not shown), as such the button clamping portion 17 can be escaped from the bottom clamping portion 13, and the intermediate shaft 10 can also be escaped from the bottom clamping portion 13, therefore the electrically folding and unfolding multi-fold umbrella is folded or unfolded.

Furthermore, the control button (not shown) includes a unfolding button 19 and a folding button 3, in the exemplary embodiment, orientations of the unfolding button 19 and the folding button 3 on the outer surface of the handle 15 are consistent with an extending direction of the intermediate shaft 10, the unfolding button 19 and the folding button 3 can also be arranged on the outer surface of the handle 15 in other manners. In detail, the unfolding button 19 is pressed to contact with the switch button 1, to close the circuit, as such the motor 20 rotates in the forward direction, the lead screw 22 brings the pulley 23 to rotate and brings the pull cord 30 to move, as such the pull cord 30 can bring the lower nest 8 to move towards the upper nest 6, therefore the electrically folding and unfolding multi-fold umbrella is unfolded; the folding button 3 is pressed to close the circuit, as such the motor 20 rotates in the backward direction, the lead screw 22 brings the pulley 23 to rotate and brings the pull cord 30 to move, as such the pull cord 30 can bring the lower nest 8 to move towards the handle 15, therefore the electrically folding and unfolding multi-fold umbrella is folded.

Preferably, the battery 16 is a rechargeable battery 16 which can be used repeatedly, as such the battery 16 is much more economical, and environment-friendly.

Referring to FIGS. 1 and 4, the intermediate shaft 10 includes an outer tube 9, at least one intermediate tube 11, and an inner tube 12, the inner tube 12, the at least one intermediate tube 11 and the outer tube 9 are sequentially sleeved one over the other from inside to outside, the intermediate tube 11 is capable to slide relative to the inner tube 12, and the outer tube 9 is capable to slide relative to the intermediate tube 11, as such the electrically folding and unfolding multi-fold umbrella is foldable, which is convenient for user to use and carry.

Furthermore, the handle 15 is fixed at one end of the inner tube 12, the lower nest 8 is movably sleeved around the outer surface of the outer tube 9, the upper nest 6 is fixed at one end of the outer tube 9 back to the handle 15, when the unfolding button 19 is pressed, the spring 50 in the intermediate shaft 10 can unfold the outer tube 9, the at least one intermediate tube 11, and the inner tube 12 according to its elastic force, the pull cord 30 brings the lower nest 8 to slide along the outer surface of outer tube 9 until resist on the upper nest 6, to finish the movement of unfolding the umbrella.

Referring to FIG. 4, the electrically folding and unfolding multi-fold umbrella includes a first rib 70, a second rib 72, and a tension spring 80, one end of the first rib 70 is connected with the upper nest 60, two ends of the second rib 71 are respectively connected with a side of the lower nest 8 and a side of the first rib 70 adjacent to the upper nest 6, two ends of the tension spring 80 are respectively connected with the first rib 70 and the second rib 71. When the folding button 3 is pressed, the pull cord 30 pulls the intermediate shaft 10 to move towards the upper nest 6, the lower nest 8 makes the first rib 70 and the second rib 71 to move inwardly according to the tension force of the tension spring 80, as such the lower nest 8 moves towards the handle 15, and the umbrella is folded.

Preferably, the first rib 7 is a multi-fold first rib 70, as such the electrically folding and unfolding multi-fold umbrella is foldable, resulting in a small volume, and a much more attractive appearance, the electrically folding and unfolding multi-fold umbrella is also convenient for user to use and carry.

Embodiment Two

Figure 6:
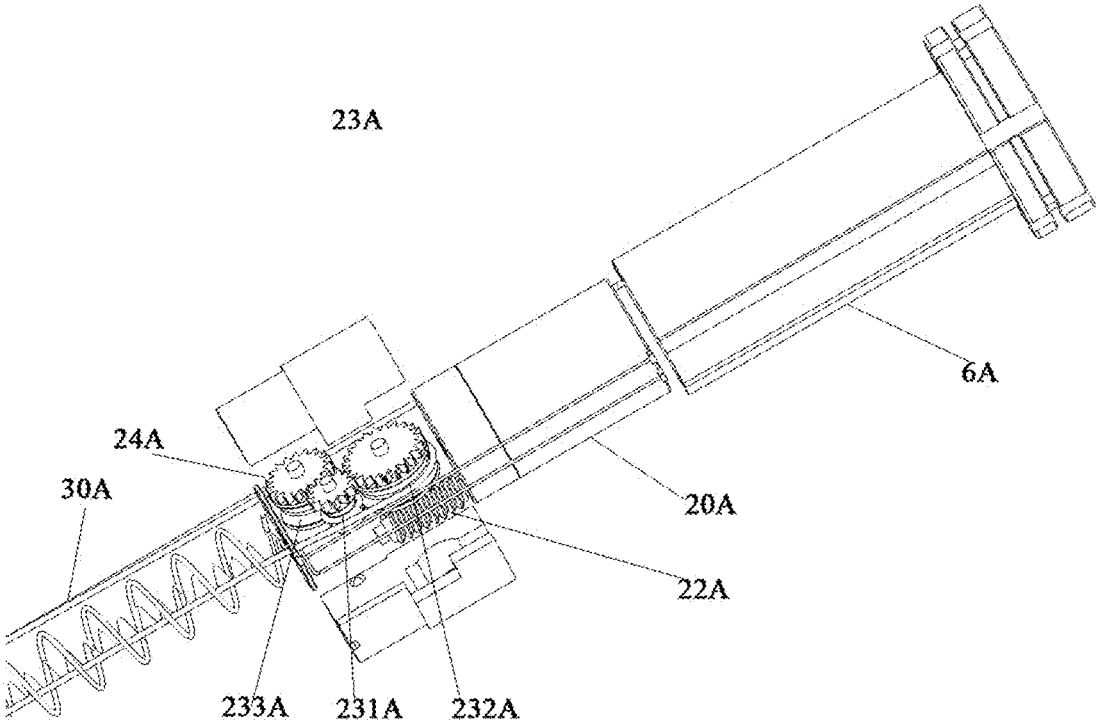
FIG. 6 is a partial enlarged diagram of the pulley of the electrically folding and unfolding multi-fold umbrella according to a second exemplary embodiment of the present disclosure.

FIG. 6 is a partial enlarged diagram of the pulley of the electrically folding and unfolding multi-fold umbrella according to a second exemplary embodiment of the present disclosure.

Referring to FIG. 6, the differences between the second embodiment and the first embodiment are: there are three pulleys 23A, axes of the three pulleys 23 A are all connected to an inner surface of the upper nest 6A, a side of each of the pulleys 23 A back to the lead screw 22A defines a second gear 24A, and each two adjacent second gears 24 A are engaged with each other, each gear 24 A is coaxial with one pulley 23A, the pull cord 30A steers by the multiple pulleys 23A in sequence. In detail, the pulleys 23 A includes a small pulley 231 A, a large pulley 232A, and a medium size pulley 233A, the large pulley 232A and the medium size pulley 233A are respectively located at two sides of the small pulleys 231A, and a side of the pulley 23A back to the lead screw 22A defines a second gear 24A, each two adjacent second gears 234A are engaged with each other, the pull cord 30A steer by the large pulley 232A, the small pulley 231A, and the medium size pulley 233A in sequence; a side of the large pulley 232A defines a first gear (not shown) which can be engaged with the lead screw 22A, the motor 20A brings the lead screw 22A to move, and then brings the large pulley 232A to rotate through the first gear (not shown), as such the motor 20A brings the small pulley 231A and the medium size pulley 233A to rotate through the engagement among the second gears 24A, as such the pull cord 30A moves, to fold or unfold the electrically folding and unfolding multi-fold umbrella. In the embodiment, the motor 20A brings the pulleys 23A to rotate through the engagement among the second gears 24A, as such the pulleys 23A can rotate much more smooth, and the pull cord 30A would not slip on the pulleys 23A, which can ensure that the cooperation between the pulleys 23A and the pull cord 30A much more strong, and further ensure the folding and unfolding operations of the electrically folding and unfolding multi-fold umbrella much more smooth.

The foregoing description merely depicts some illustrative embodiments of the present application and therefore is not intended to limit the scope of the application. An equivalent structural or flow changes made by using the content of the specification and drawings of the present application, or any direct or indirect applications of the disclosure on any other related fields shall all fall in the scope of the application.

What is claimed is:

1. An electrically folding and unfolding multi-fold umbrella, comprising a handle, a pull cord, and an intermediate shaft fixedly connected with the handle, the handle being defined at one end of the intermediate shaft, an upper nest and a lower nest being defined at two sides of the intermediate shaft respectively, and the lower nest being adjacent to the handle, a motor, a first gear, and at least one upper pulley being all located in the upper nest, the first gear being coaxial with one upper pulley, a side of the motor adjacent to the handle defining a lead screw which being engaged with the first gear, an axis of the upper pulley being connected to an inner surface of the upper nest, a lower fixed pulley being defined at a side of an inner surface of the lower nest, one end of the pull cord being fixed in the end of the intermediate shaft adjacent to the handle, the other end of the pull cord being fixed on the upper nest after steering by the upper pulley in the upper nest and the lower fixed pulley in the lower nest in sequence.

2. The electrically folding and unfolding multi-fold umbrella according to claim 1, wherein there are three upper pulleys, axes of the three upper pulleys are all connected to the inner surface of the upper nest, the pull cord steers by the three upper pulleys in sequence.

3. The electrically folding and unfolding multi-fold umbrella according to claim 1, wherein there are three upper pulleys, respectively being a first upper pulley, a second upper pulley and a third upper pulley, axes of the three upper pulleys are all connected to the inner surface of the upper nest, a side of each upper pulley away from the lead screw defines a second gear, the second gear corresponding to the first upper pulley is engaged with the second gear corresponding to the second upper pulley; the second gear corresponding to the second upper pulley is engaged with the second gear corresponding to the third upper pulley, each of the second gears is coaxial with one corresponding upper pulley, the pull cord steers by the upper pulleys in sequence.

4. The electrically folding and unfolding multi-fold umbrella according to claim 1, wherein a battery, an electric wire, and a switch component are all located in the handle, the switch component is connected with the battery through the electric wire, a spring and a spring type wire are defined in the intermediate shaft, the switch component is connected with the motor through the spring and the spring type wire, an outer surface of the handle defines a control button which is capable to contact with the switch component.

5. The electrically folding and unfolding multi-fold umbrella according to claim 4, wherein the control button comprises an unfolding button and a folding button, orientation of the unfolding button and the folding button on the outer surface of the handle are consistent with an extending direction of the intermediate shaft.

6. The electrically folding and unfolding multi-fold umbrella according to claim 4, wherein the battery is a rechargeable battery.

7. The electrically folding and unfolding multi-fold umbrella according to claim 4, wherein the switch component comprises a switch button, a double-pole double-throw switch, a bottom clamping portion, a button clamping portion, and a button spring, the switch button and the button clamping portion are respectively defined at two opposite sides of a top end of the handle, two ends of the button spring respectively resist on the button clamping portion and an inner surface of the handle, the button clamping portion is defined at one end of the intermediate shaft adjacent to the handle, and the bottom clamping portion resists on the button clamping portion, the electric wire is respectively connected with the battery, the double-pole double-throw switch, the switch button, the spring, and the spring type wire.

8. The electrically folding and unfolding multi-fold umbrella according to claim 1, wherein the intermediate shaft comprises an outer tube, at least one intermediate tube, and an inner tube, the inner tube, the at least one intermediate tube and the outer tube are sequentially sleeved one over the other from inside to outside, the intermediate tube is capable to slide relative to the inner tube, and the outer tube is capable to slide relative to the intermediate tube.

9. The electrically folding and unfolding multi-fold umbrella according to claim 8, wherein the handle is fixed at one end of the inner tube, the lower nest movably sleeves around an outer surface of the outer tube, the upper nest is fixed at one end of the outer tube away from the handle.

10. The electrically folding and unfolding multi-fold umbrella according to claim 8, wherein the electrically folding and unfolding multi-fold umbrella comprises a first rib, a second rib, and a tension spring, one end of the first rib is connected with the upper nest, two ends of the second rib are respectively connected with a side of the lower nest and a side of the first rib adjacent to the upper nest, two ends of the tension spring are respectively connected with the first rib and the second rib.

11. The electrically folding and unfolding multi-fold umbrella according to claim 10, wherein the first rib is a multi-fold first rib.

* * * * *